US009582021B1

(12) United States Patent
Arnold et al.

(10) Patent No.: US 9,582,021 B1
(45) Date of Patent: Feb. 28, 2017

(54) BANDGAP REFERENCE CIRCUIT WITH CURVATURE COMPENSATION

(71) Applicant: Texas Instruments Deutschland GmbH, Freising (DE)

(72) Inventors: Matthias Arnold, Zolling (DE); Asif Qaiyum, Freising (DE)

(73) Assignee: TEXAS INSTRUMENTS DEUTSCHLAND GMBH, Freising (DE)

( * ) Notice: Subject to any disclaimer, the term of this patent is extended or adjusted under 35 U.S.C. 154(b) by 0 days.

(21) Appl. No.: 14/947,525

(22) Filed: Nov. 20, 2015

(51) Int. Cl.
*G05F 3/26* (2006.01)
*G05F 3/16* (2006.01)

(52) U.S. Cl.
CPC . *G05F 3/16* (2013.01); *G05F 3/26* (2013.01)

(58) Field of Classification Search
CPC . G05F 3/16; G05F 3/222; G05F 3/242; G05F 3/26; G05F 3/267; G05F 3/30
See application file for complete search history.

(56) References Cited

U.S. PATENT DOCUMENTS 6,255,807 B1 7/2001 Doorenbos et al.
7,808,305 B2 * 10/2010 Kim ..... G05F 3/30 327/538
9,104,217 B2 8/2015 Arnold
2013/0265083 A1 * 10/2013 Lin ..... H02M 11/00 327/103
2014/0077789 A1 * 3/2014 Hu ..... G05F 3/02 323/313
2016/0077540 A1 * 3/2016 Ye ..... G05F 3/30 323/313

OTHER PUBLICATIONS

Filanovsky et al., "BiCMOS Cascaded Bandgap Voltage Reference", 39th Midwest symposium on Circuits and Systems, vol. 2 (IEEE, 1996), pp. 943-946.
Tsividis et al., "Accurate Analysis of Temperature Effects in Ic-Vbe Characteristics with Application to Bandgap Reference Sources", J. Solid State Circ., vol. SC-15, No. 6 (IEEE, 1980), pp. 1076-1084.
Pertijs et al., "Precision Interface Electronics for a CMOS Smart Temperature Sensor", 4th IEEE Conference on Sensors (IEEE, 2005), pp. 943-946.
U.S. Appl. No. 14/854,600, filed Sep. 15, 2015.
Sansen, "Bandgap and current reference circuits", lecture handout (KULeuven, 2005), pp. 161-169, 1610-1653, available at http://iroi.seu.edu.cn/teachers/chym/analog/16.pdf.

* cited by examiner

*Primary Examiner* — Matthew Nguyen
(74) *Attorney, Agent, or Firm* — John R. Pessetto; Charles A. Brill; Frank D. Cimino

(57) ABSTRACT

A bandgap reference circuit with curvature compensation. The circuit includes a first current mirror that mirrors the current conducted by the bandgap reference. A difference between the gate-to-source voltages in the two legs provides a first mirrored current with non-linear temperature stability. This first mirrored current is again mirrored by a second current mirror in which the mirror transistors also have differing gate-to-source voltages, with the current from this second current mirror coupled to the bandgap reference to compensate for curvature in the CTAT current over temperature.

13 Claims, 3 Drawing Sheets

BANDGAP REFERENCE CIRCUIT WITH CURVATURE COMPENSATION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention is in the field of voltage and current reference circuits as used in integrated circuits. Embodiments are directed to curvature compensation in reference circuits of the bandgap reference type.

The powerful computational and operation functionality provided by modern integrated circuits has enabled the more widespread distribution of computing power in larger-scale systems. One example of such distributed electronic functionality is the so-called "Internet of Things" (IoT) contemplates the widespread deployment of electronic devices as sensors and controllers, with networked communications among those devices. Modern smartphones and wearables also deploy computational and operational functionality into a large number of distributed nodes; implantable medical devices constitute another type of distributed functionality. Many of these applications necessitate the use of batteries or energy scavenging devices to power the integrated circuits. As such, many modern integrated circuits are called upon to be "power-aware", designed to consume minimal power during operation and standby.

Voltage and current reference circuits are important functions in a wide range of modern analog, digital, and mixed-signal integrated circuits, in order to optimize the performance of such circuits as operational amplifiers, comparators, analog-to-digital and digital-to-analog converters, oscillators, phase-locked loops and other clock circuits, and the like. This optimization is especially important for power-aware applications in which power consumption can be a dominating factor in circuit and system design. As well known in the art, voltage and current reference circuits ideally generate their reference levels in a manner that are stable over variations in process parameters, power supply voltage levels, and operating temperature.

FIG. 1 illustrates "bandgap" reference circuit 10, constructed in the conventional manner. In this example, p-channel metal-oxide-semiconductor (PMOS) transistor 6*p*, with its source at the $V_{dd}$ power supply voltage, serves as a current source to two bipolar transistor branches to which its drain is connected through resistor 7. One branch is formed by resistor 9*a* connected between resistor 7 and the emitter of p-n-p transistor 8*a*, while the other branch is formed by resistor 9*b* connected between resistor 7 and resistor 11, which in turn is connected to the emitter of p-n-p transistor 8*b*. Typically, transistor 8*b* will have an emitter area that is some multiple N:1 of the emitter area of transistor 8*a*, so that the currents conducted by the two transistors are similarly ratioed. The bases and collectors of transistors 8*a*, 8*b* are connected to the $V_{ss}$ reference level. This construction of reference circuit 10 is common in complementary metal-oxide-semiconductor (CMOS) integrated circuits, as bipolar p-n-p transistors 8*a*, 8*b* are typically present as parasitic devices in the CMOS structure. In this conventional arrangement, the emitter of transistor 8*a* is connected to one input of amplifier 15, while the other input of amplifier 15 is connected to the node between resistors 9*b* and 11. The output AMPOUT of amplifier 15 is connected to the gate of transistor 6*p*.

According to this construction, the output voltage AMPOUT from amplifier 15 is based on one parameter that varies in a manner complementary to absolute temperature (CTAT) combined with another parameter that varies proportionally with temperature (PTAT). The CTAT parameter in this circuit is the base-emitter voltage of transistor 8*a*, and the PTAT parameter is the difference in the base-emitter voltages of transistors 8*a*, 8*b*, which is reflected as the voltage drop across resistor 11. The sum of these two voltages is thus constant over variations in temperature, at least to a first approximation, and appears at the drain of transistor 6*p* as output voltage VBG. This output voltage VBG is typically at about the bandgap voltage of the semiconductor (e.g., 1.2 volts for silicon), and as such reference circuit 10 is thus commonly referred to in the art as a "bandgap reference circuit". Additional transistors (not shown) are typically mirrored with PMOS transistor 6*p* to establish and provide output currents that are similarly stable over variations in temperature. Reference circuit 10 can be made "self-biased" by biasing amplifier 15 with a copy of the current conducted by transistor 6*p*, in which case the circuit will be relatively insensitive to variations in the Vdd power supply voltage.

However, the base-emitter voltages of bipolar transistors 8*a*, 8*b* are not exactly linear over temperature because of non-linear temperature behavior in the bipolar junction transistor (BJT) saturation current. The combination of the CTAT base-emitter voltage with the PTAT difference in base-emitter voltages is thus often insufficient to attain the desired temperature stability of the reference voltage. This variation of base-emitter voltage ($V_{be}$) over temperature is generally referred to as the "curvature" of $V_{be}$, referring to the curve in the $V_{be}$ vs. temperature characteristic from the linearly CTAT ideal.

FIG. 2 illustrates a simplified schematic of reference circuit 10' including curvature compensation according to one conventional technique. Reference circuit 10' is constructed similarly as reference circuit 10 described above in connection with FIG. 1, but with n-channel MOS (NMOS) transistor 6*n* in place of PMOS transistor 6*p*. In this conventional reference circuit 10', curvature compensation is provided by resistor 13, which is formed in an n-type well in the integrated circuit; in contrast, resistors 9*a*, 9*b*, 11 are typically formed in polycrystalline silicon. Because of its formation in an n-well, resistor 13 will exhibit a non-linear temperature coefficient, and thus the collector currents will develop a non-linear voltage across resistor 13. The non-linearity of this voltage drop across resistor 13 tends to compensate for the non-linearity of $V_{be}$ over temperature. While this curvature compensation is relatively easy to design and implement, without requiring significant modifications to existing circuits, the n-well realization of resistor 13 introduces additional process sensitivity, specifically sensitivity to variations in n-well sheet resistance, which is a difficult parameter to control over typical process windows. This approach to curvature compensation is thus typically less robust than required for good yield and performance.

Another conventional approach for curvature compensation involves the introduction of a non-linear bias current to cancel out the non-linearity of $V_{be}$ over temperature. Filanovsky et al., "BiCMOS Cascaded Bandgap Voltage Reference", *IEEE 39th Midwest symposium on Circuits and Systems*, Vol. 2 (IEEE, 1996), pp.943-946describes this approach as carried out by a translinear current polynomial circuit to produce a current that is PTAT to the third degree (i.e., proportional to $T^3$), and a current that is PTAT to the fourth degree. These currents are added with the collector current in the reference circuit to compensate for non-linearities. However, this approach necessitates the formation of cascaded bipolar transistors, and thus not conducive to implementation in CMOS technologies (in which the collectors of parasitic bipolar devices are all connected to the substrate).

Another approach to curvature compensation is described in U.S. Pat. No. 6,255,807, incorporated herein by reference. According to this technique, an additional amplifier gain stage is added to the reference circuit, and adds non-linearity into the feedback loop. While this technique provides good curvature compensation, the additional amplifier stage requires significant chip area to implement, and consumes additional power that renders it less than optimal for power-aware applications.

By way of further background, U.S. Pat. No. 9,104,217, issued Aug. 11, 2015, commonly assigned herewith and incorporated herein by reference, describes a reference circuit with curvature compensation implemented by way of a translinear circuit that draws a non-linear current from the bipolar collector currents, and that can be realized by MOS transistors.

BRIEF SUMMARY OF THE INVENTION

Disclosed embodiments provide an efficient circuit to implement curvature compensation for a bandgap reference circuit implemented in complementary metal-oxide-semiconductor (CMOS) technology.

Disclosed embodiments provide such a circuit that is robust to variations in manufacturing process parameters.

Disclosed embodiments provide such a circuit that consumes relatively little power and as such is suitable for use in power-aware applications.

Disclosed embodiments provide such a circuit that accomplishes curvature correction with excellent power supply rejection and temperature drift stability.

Other objects and advantages of the disclosed embodiments will be apparent to those of ordinary skill in the art having reference to the following specification together with its drawings.

According to certain embodiments, a reference circuit with curvature compensation can be implemented by nested current mirrors. The first current mirror includes a first resistor that biases the gate-to-source voltage of a current control transistor in the bandgap reference core differently from that of a mirror transistor. The current conducted by the mirror transistor is forwarded to a reference transistor in the second current mirror, which is biased to have a gate-to-source voltage different from that of a second mirror transistor. This second mirror transistor draws a translinear current from the bandgap reference core, which varies non-linearly with temperature to provide the desired curvature compensation.

DETAILED DESCRIPTION OF THE INVENTION

The one or more embodiments described in this specification are implemented into a bandgap reference circuit realized by way of a complementary metal-oxide-semiconductor (CMOS) technology, as it is contemplated that such implementation is particularly advantageous in that context. However, it is also contemplated that concepts of this invention may be beneficially applied to other applications, for example integrated circuits constructed by way of a bipolar-CMOS (BiCMOS) technology. Accordingly, it is to be understood that the following description is provided by way of example only, and is not intended to limit the true scope of this invention as claimed.

Figure 3:
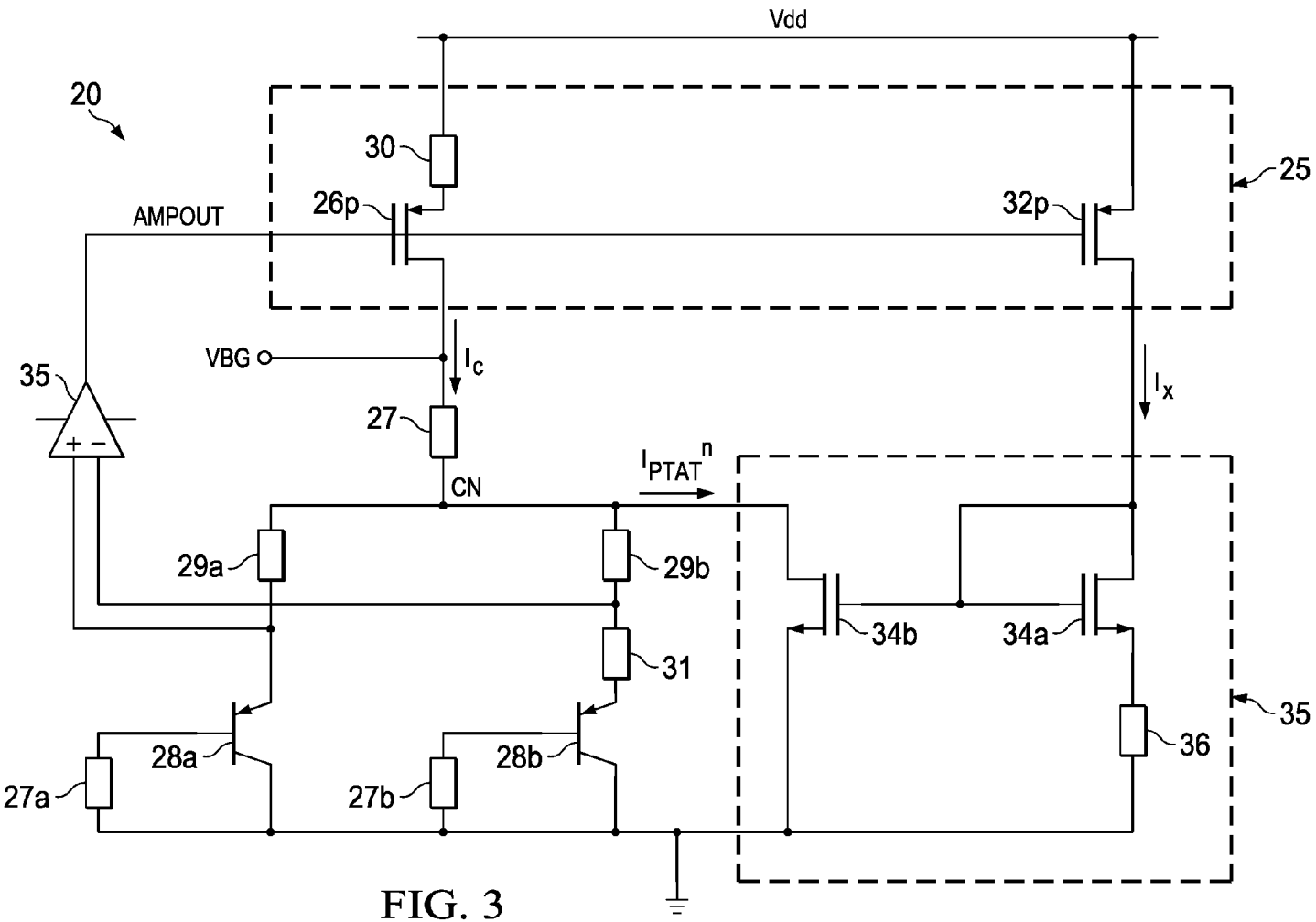
FIG. 3 is an electrical diagram, in schematic form, of a bandgap reference circuit with curvature compensation according to an embodiment.

FIG. 3 illustrates the construction of reference circuit 20 according to an embodiment. As will be described in this specification, reference circuit 20 includes compensation for non-linearity in the temperature behavior of a typical bandgap reference circuit construction.

Figure 1:
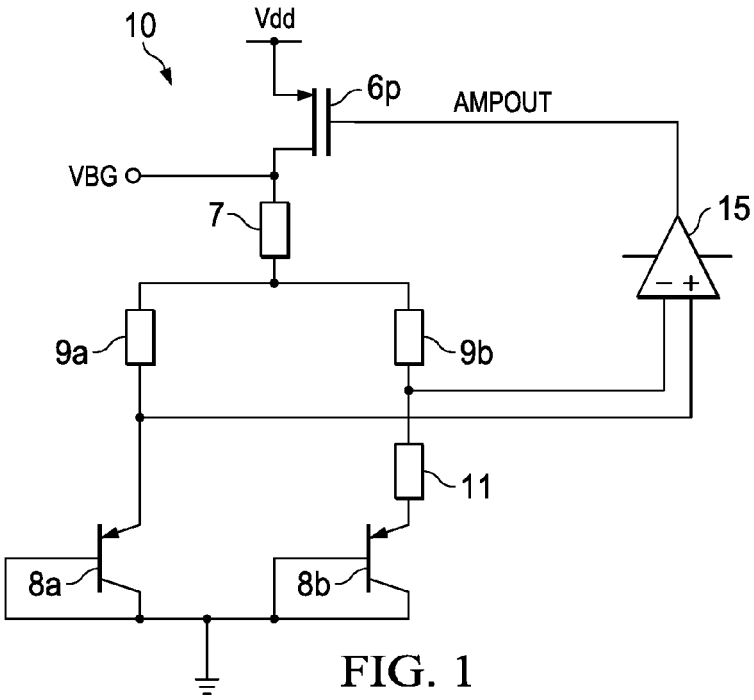
FIG. 1 (PRIOR ART)
FIG. 1 is an electrical diagram, in schematic form, of a conventional bandgap reference circuit.
Figure 2:
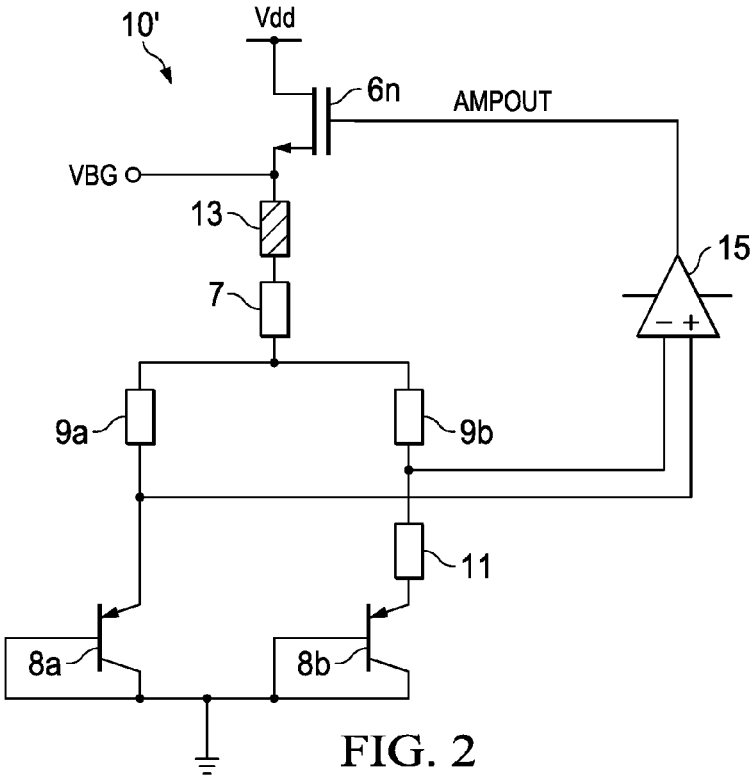
FIG. 2 (PRIOR ART)
FIG. 2 is an electrical diagram, in schematic form, of another conventional bandgap reference circuit.

According to this embodiment, reference circuit 20 includes a conventional bandgap reference circuit core that is generally similar to the circuits described above relative to FIGS. 1 and 2. More specifically, this conventional bandgap core includes a pair of p-n-p bipolar transistors 28*a*, 28*b*, each with its collector at ground; the bases of transistors 28*a*, 28*b* are coupled to ground via (optional) resistors 27*a*, 27*b*, respectively. Typically, the emitter area of transistor 28*b* will be larger than that of transistor 28*a* by some multiple (e.g., on the order of 20). Because the collectors of transistors 28*a*, 28*b* are both at ground, reference circuit 20 according to this embodiment is suitable for implementation in a CMOS integrated circuit by realizing transistors 28*a*, 28*b* by parasitic p-n-p structures, in which the collector node is naturally at the substrate (i.e., at $V_{ss}$ for the CMOS devices). If included, resistors 27*a*, 27*b* may be polysilicon or n-well resistors as known in the art. Transistors 28*a*, 28*b* thus provide a pair of parallel connected circuit branches in reference circuit 20, as typical in the art for bandgap reference circuits.

Amplifier 35 in this embodiment is a differential operational transconductance amplifier (OTA), and has an input coupled to each of the two circuit branches. The positive (non-inverting) input of amplifier 35 is connected to the emitter of transistor 28*a* in one circuit branch, and the negative (inverting) input of amplifier 35 is connected to the emitter of transistors 28*b* via polysilicon resistor 31 in the other branch. Polysilicon resistors 29*a*, 29*b* couple these amplifier input nodes in the respective circuit branches together at a node that will be referred to in this specification as common node CN, as shown in FIG. 3.

P-channel MOS (PMOS) transistor 26*p* has its drain coupled to common node CN via polysilicon resistor 27. The gate of transistor 26*p* receives the level AMPOUT from the output of amplifier 35, and the source of transistor 26*p* is biased to the $V_{dd}$ power supply through polysilicon resistor 30 according to this embodiment. Transistor 26*p* thus controls the sum of the current in the two circuit branches (i.e., conducted by transistors 28*a*, 28*b*) in response to the voltage AMPOUT produced by amplifier 35. As known in the art and as shown in FIG. 3, a bandgap reference voltage VBG can be taken at the drain node of transistor 26*p*.

In reference circuit 20 according to this embodiment, compensation for non-linear variations in the base-emitter voltages of transistors 28*a*, 28*b* is implemented by way of nested current mirrors 25, 35. Current mirror 25 operates to mirror the current $I_C$ conducted by transistor 26*p*, that current $I_C$ being the sum of the currents in the bipolar transistor branches, to produce mirror current $I_X$ conducted by mirror transistor 32*p*. In the embodiment of FIG. 3, mirror transistor 32*p* is a PMOS transistor with its source at the $V_{dd}$ power supply and its gate connected to the gate of transistor 26*p*. The strength (e.g., width-to-length ratio) of transistor 32*p* may be a multiple of that of transistor 26*p*, if desired, in which case current $I_X$ will be a corresponding multiple of current $I_C$. However, resistor 30 in current mirror 25 results in the gate-to-source voltage $V_{gs}$ of transistor 26*p* differing from that of mirror transistor 32*p*, by the voltage drop across resistor 30. Similarly, a resistor may also be present between the source of transistor 32*p* and the $V_{dd}$ power supply, so long as it has a different resistance than that of resistor 30 to establish a differential in the gate-to-source voltages of transistors 26*p* and 32*p*. As will be discussed below, this differential in gate-to-source voltages assists the curvature compensation attained in reference circuit 20.

Current $I_X$ is communicated to second current mirror 35 in this embodiment. Specifically, the drain of PMOS transistor 26*p* is connected to the drain and gate of re-channel MOS (NMOS) transistor 34*a*; the source of NMOS transistor 34*a* is coupled to ground (i.e., the $V_{ss}$ voltage) by polysilicon resistor 36. Current mirror 35 also includes mirror transistor 34*b*, which is an NMOS transistor with its source at $V_{ss}$, its gate connected to the gate and drain of transistor 34*a*, and its drain connected to common node CN. If desired, the width-to-length ratio of NMOS mirror transistor 34*b* may be a multiple of that of transistor 34*a*. The current $I_x$ conducted by transistor 34*a* is thus mirrored as current $I_{PTAT}^n$ conducted by transistor 34*b*, at a multiple corresponding to the relative width-to-length of transistors 34*a*, 34*b*. Similarly as in current mirror 25, the gate to source voltage of transistor 34*a* differs from that of transistor 36*a*, specifically by the voltage drop across resistor 36. As will be discussed below, this differential in gate-to-source voltages assists in providing curvature compensation for reference circuit 20.

It is contemplated that the particular construction of reference circuit 20 may vary from that described above and illustrated in FIG. 3. For example, a different type of amplifier than a differential OTA may be used to realize amplifier 35, or different transistor types (e.g., n-p-n bipolar, or specifically fabricated devices rather than parasitic structures) may be used instead of the parasitic p-n-p structures for transistors 28*a*, 28*b*. In addition, as typical in the art, ancillary circuits may be implemented in combination with reference circuit 20 as shown in FIG. 3. For example, one or more output transistors or complementary transistor pairs may be coupled to reference circuit 20, for example as additional current mirrors with transistor 26*p*, to drive output reference currents based on the same bandgap operation. In addition, a startup circuit may be provided to ensure that reference circuit 20 powers up at the desired operating point; our copending application S.N. 14/854,600, filed Sep. 15, 2015, commonly assigned herewith and incorporated herein by reference, describes examples of a startup circuit suitable for use with reference circuit 20. It is contemplated that these and other alternatives and variations that will be apparent to those skilled in the art having reference to this specification are within the scope of the claims below.

The bandgap reference core of reference circuit 20 operates in the conventional manner for self-biased circuits of this type, with the circuit branches of bipolar transistors 28*a*, 28*b* dividing the current $I_C$ conducted by transistor 26*p* according to their relative device strengths and series resistances. Amplifier 35 operates to control the voltage AMOUT at the gate of transistor 26*p*, and thus the level of this current $I_C$. Specifically, as known in the art, the voltage level AMPOUT at the output of amplifier 35 is based on the combination of a CTAT (complementary to absolute temperature) voltage, namely the base-emitter voltage of transistor 28*a*, and a PTAT (proportionally to absolute temperature) voltage, namely the voltage drop across resistor 31 corresponding to the difference in base-emitter voltages of transistors 28*a* and 28*b*. Because these voltages vary over in temperature in opposition with one another, this combination is relatively insensitive to temperature, at least to a first order approximation. However, non-linearity in the variation of bipolar saturation current with temperature is reflected in curvature of the CTAT voltage of base-emitter voltage of transistor 28*a* from its linear ideal. Nested current mirrors 25, 35 compensate for this curvature, as will now be described.

Figure 4A:
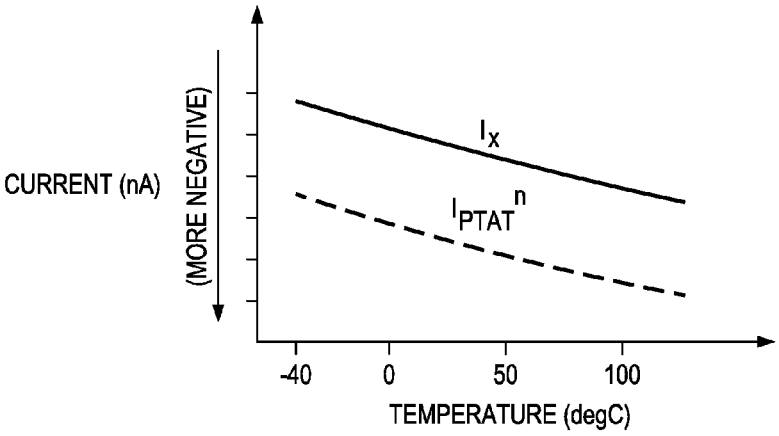
FIGS. 4*a* through 4*c* are plots of current, slope, and bandgap voltage, respectively, over temperature as exhibited by the circuit of FIG. 3 according to that embodiment.
Figure 4B:
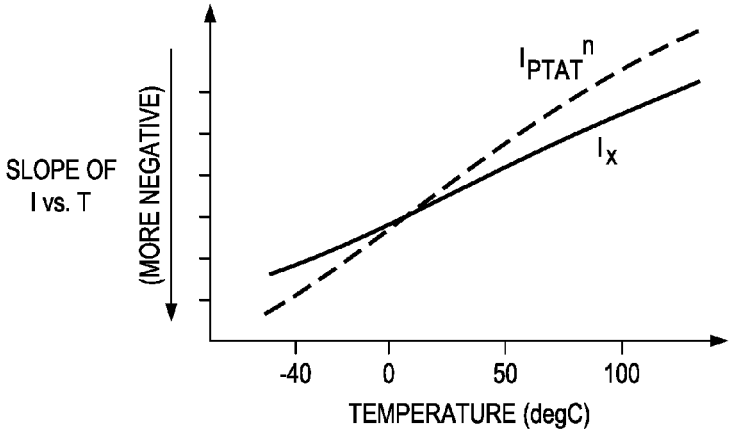

As described above, resistor 30 in current mirror 25 causes the gate-to-source voltage $V_{gs}$ of PMOS transistor 26*p* to differ from that of PMOS mirror transistor 32*p*. More specifically, the gate-to-source voltage $V_{gs32}$ of mirror transistor 32*p*, in terms of the gate-to-source voltage $V_{gs26}$ of current control transistor 26*p*, is:

$$V_{gs32}=V_{gs26}+I_C \cdot R_{30}$$

where $R_{30}$ is the resistance of resistor 30, and the current $I_X$ conducted by mirror transistor 32*p* being:)

$$I_X \sim m \cdot (V_{gs26}+(I_C \cdot R_{30})-V_{T32})^2$$

where m is the scaling ratio (e.g., ratio of the W/L ratios) of mirror transistor 32*p* relative to transistor 26*p*, and $V_{T32}$ is the threshold voltage of transistor 32*p*. This difference in gate-to-source voltage between transistors 26*p* and 32*p* results in distortion in the variation of the mirrored current $I_X$ over temperature relative to the temperature variation of current $I_C$ on which it is based. This distortion is illustrated in FIG. 4*a*, which illustrates the curvature of current $I_X$ over temperature for an example of reference circuit 20. FIG. 4*b* plots the slope of the $I_X$ vs. temperature plot over the same temperature range, which more plainly shows the non-linearity of mirrored current $I_X$ over temperature (an exactly linear temperature variation would appear as a horizontal line in FIG. 4*b*).

Current mirror 35 operates in a similar fashion to further distort the temperature behavior in mirrored current $I_{PTAT}^n$ as compared with mirrored current $I_X$. If the transistor strength (W/L ratio) of transistor 34*b* is ratioed relative to that of transistor 34*a*, current $I_{PTAT}^n$ will be similarly ratioed relative to current $I_X$. As described above, the gate-to-source voltage $V_{gs34b}$ of mirror transistor 34*b* differs from the gate-to-source voltage $V_{gs34a}$ of reference transistor 34*a* that conducts current $I_X$:

$$V_{gs34b}=V_{gs34a}+I_X R_{36}$$

where $R_{36}$ is the resistance of resistor 36 connected between the source of reference transistor 34*a* and ground in the embodiment of FIG. 3. The relationship of current $I_{PTAT}^n$ to the gate-to-source voltage $V_{gs34b}$ will depend on the bias at transistor 34*b*. Specifically, if transistor 34*b* is in weak inversion, current $I_{PTAT}^n$ will depend exponentially on the gate-to-source voltage $V_{gs34b}$, and if transistor 34*b* is in strong inversion, current $I_{PTAT}^n$ will depend on the gate-to-source voltage $V_{gs34b}$ according to a square law; biasing transistor 34*b* at a point near the boundary of those regions will result in a dependence somewhere between the two. It is contemplated that those skilled in the art having reference to this specification will be readily able to configure reference circuit 20 so that transistor 34*b* is biased at the desired point to obtain a desired current-voltage relationship, without undue experimentation.

In any case, the difference in gate-to-source voltage between transistors 34*a* and 34*b* distorts the temperature variation of the mirrored current $I_{PTAT}^n$ over temperature relative to the temperature variation of current $I_x$, which itself exhibits a distorted temperature variation relative to reference current $I_C$ in the bandgap core. As a result, the temperature variation of mirrored current $I_{PTAT}^n$ is even more distorted from linear than is current $I_X$, as shown by its stronger curvature in the current-temperature plane as shown in FIG. 4*a*. This additional distortion is more dramatically illustrated in FIG. 4*b*, which shows that the rate of change of the temperature variation of mirrored current $I_{PTAT}^n$ is steeper than that of current $I_X$, for an example of reference circuit 20.

As described above and as shown in FIG. 3, mirrored current $I_{PTAT}^n$ is a translinear current that is drawn from common node CN, and thus from the sum of the currents conducted by the circuit branches of bipolar transistors 28*a*, 28*b*. The non-linearity of this mirrored current $I_{PTAT}^n$ with temperature is essentially an $n^{th}$ power PTAT relationship with temperature, as indicated by the nomenclature $I_{PTAT}^n$. The specific power n of this relationship will depend on the bias point of transistor 34*b* (i.e., weak inversion, strong inversion, or somewhere in between). It is contemplated that one skilled in the art having reference to this specification will be readily able to apply the appropriate bias to obtain the desired value of this exponent n so that mirrored current $I_{PTAT}^n$ will compensate for the curvature in the CTAT behavior of current $I_C$ due to the nonlinearity of base-emitter voltage with temperature in the bipolar branches of reference circuit 20. Adjustment of current $I_C$ by this current $I_{PTAT}^n$ will stabilize, over temperature variations, the reference voltages and currents established by reference circuit 20.

Figure 4C:
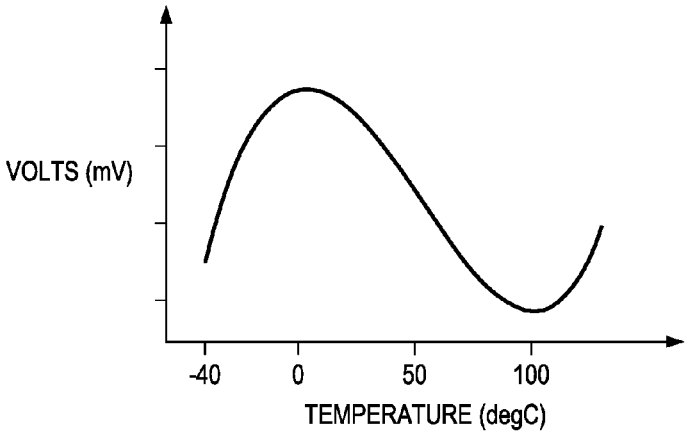

In particular, it is contemplated that improved stability of output bandgap voltage VBG over temperature will be attained by reference circuit 20 according to this embodiment. As known in the art, the curvature in the CTAT current due to base-emitter voltage nonlinearity over temperature typically appears as a parabolic relationship of the output bandgap voltage with temperature. In contrast, it is contemplated that the output bandgap voltage VBG of reference circuit 20, compensated according to this embodiment, will exhibit second order correction behavior over temperature, such as illustrated by way of example in FIG. 4*c*. This second order correction behavior is known in the art as a signature of curvature compensation. It is contemplated that the overall variation in output bandgap voltage VBG of reference circuit 20 according to this embodiment will typically be very small, such as on the order of 5 mV or less.

Variations and alternatives to the implementation of reference circuit shown in FIG. 3 are contemplated. One such variation is the addition of one or more additional translinear stages, for example in the form of additional mismatched current mirrors, that contribute in the establishment of current $I_{PTAT}^n$. With reference to FIG. 3, an additional current mirror would include another instance of PMOS transistor 32*p*, similarly with its gate receiving the output of amplifier 35 on line AMPOUT and its source biased from the $V_{dd}$ power supply voltage to have a different gate-to-source voltage than transistor 26*p*; the current conducted by this parallel PMOS transistor would be applied to another instance of current mirror 35, so as to draw an additional component of current $I_{PTAT}^n$ from common node CN. It is contemplated that this and other variations that will be apparent to those skilled in the art having reference to this specification are within the scope of this invention as claimed.

The implementation of curvature correction for a voltage reference circuit according to these embodiments provides important benefits and advantages. One such advantage provided by this approach is its provision of a translinear current mode circuit (e.g., current mirrors 25, 35) into the reference circuit so as to be self-biased. More specifically, no external bias current is required in reference circuit 20 of FIG. 3 in order to establish the compensating mirrored current $I_{PTAT}^n$. Accordingly, variations in current $I_C$ in the main leg of reference circuit 20 due to variations in power supply voltage or manufacturing process parameters will be reflected in mirrored currents $I_X$ and $I_{PTAT}^n$. This self-biasing improves the power supply rejection of these embodiments from previous curvature compensation techniques in which variations of the applied bias current with power supply voltage is independent of the current $I_C$ being regulated.

In addition, curvature compensation according to these embodiments may be implemented in a simple and efficient manner. Implementation of the additional current mirrors in this arrangement requires a relatively small number of additional transistors and other devices, and as such can be realized efficiently from the standpoint of chip area. This construction also permits application of curvature correction in a wide range of self-biased bandgap reference circuit designs. In addition, variations in transistor parameters or polysilicon sheet resistance in the bandgap circuit core will be tracked in devices in the nested current mirrors, resulting in a reference circuit design that is quite robust over variations in temperature, process parameters, and power supply voltage, with good temperature drift stability. Furthermore, the additional power consumed by the curvature compensation function according to these embodiments is extremely low, enabling this approach to be used in power-aware applications.

While one or more embodiments have been described in this specification, it is of course contemplated that modifications of, and alternatives to, these embodiments, such modifications and alternatives capable of obtaining one or more the advantages and benefits of this invention, will be apparent to those of ordinary skill in the art having reference to this specification and its drawings. It is contemplated that such modifications and alternatives are within the scope of this invention as subsequently claimed herein.

What is claimed is:

1. A reference circuit, comprising:

a first circuit branch comprising a bipolar transistor and a resistor connected in series with a conduction path of the bipolar transistor between a common node and a ground voltage;

a second circuit branch comprising a bipolar transistor and a pair of resistors connected in series with a conduction path of the bipolar transistor between the common node and the ground voltage;

a current control transistor having a conduction path and a gate;

a first resistor connected to the common node and in series with the conduction path of the current control transistor;

an amplifier having inputs coupled to nodes in the first and second circuit branches, and an output coupled to the gate of the current control transistor;

a first current mirror comprising:

a first mirror transistor, having a gate coupled to the output of the amplifier and the gate of the current control transistor, and having a conduction path connected on one side to the power supply voltage so that the first mirror transistor has a gate-to-source voltage different from that of the current control transistor; and a second current mirror comprising:

a reference transistor having a gate and drain connected together and to another side of the conduction path of the first mirror transistor, and having a source;

a second mirror transistor having a drain connected to the common node, a gate connected to the gate and drain of the reference transistor, and a source connected to the ground voltage so that the second mirror transistor has a gate-to-source voltage different from that of the reference transistor.

2. The circuit of claim 1, wherein the first current mirror further comprises:

a second resistor connected between the conduction path of the current control transistor and a power supply voltage, the second resistor establishing the gate-to-source voltage at the current control transistor as different from that of the first mirror transistor.

3. The circuit of claim 2, wherein the second current mirror further comprises:

a third resistor connected between the source of the reference transistor and the ground voltage, the second resistor establishing the gate-to-source voltage at the reference transistor as different from that of the second mirror transistor.

4. The circuit of claim 2, wherein the current mirror further comprises:

a fourth resistor connected between the conduction path of the first mirror transistor and the power supply voltage, the fourth resistor having a resistance different from that of the first transistor to establish the gate-to-source voltage of the first mirror transistor as different from that of the current control transistor.

5. The circuit of claim 1, wherein the current control transistor and the first mirror transistor are each p-channel metal-oxide-semiconductor transistors.

6. The circuit of claim 5, wherein the reference transistor and the second mirror transistor are each n-channel metal-oxide-semiconductor transistors.

7. The circuit of claim 1, wherein one input of the amplifier is connected to a node between the conduction path of the bipolar transistor and the resistor in the first circuit branch;

and wherein another input of the amplifier is connected to a node between the pair of resistors in the second circuit branch.

8. The circuit of claim 1, further comprising:

a third current mirror comprising:

a third mirror transistor, having a gate coupled to the output of the amplifier and the gate of the current control transistor, and having a conduction path connected on one side to the power supply voltage so that the third mirror transistor has a gate-to-source voltage different from that of the current control transistor; and a fourth current mirror comprising:

a reference transistor having a gate and drain connected together and to another side of the conduction path of the first mirror transistor, and having a source;

a fourth mirror transistor having a drain connected to the common node, a gate connected to the gate and drain of the reference transistor, and a source connected to the ground voltage so that the fourth mirror transistor has a gate-to-source voltage different from that of the reference transistor.

a fifth resistor connected between the source of the reference transistor and the ground voltage, the fifth resistor establishing the gate-to-source voltage at the reference transistor as different from that of the fourth mirror transistor.

9. A method of generating a reference voltage, comprising:

conducting a first current through a current control transistor;

splitting the first current at a common node between first and second circuit branches, each including a bipolar transistor;

controlling a gate voltage of the current control transistor responsive to voltages at respective nodes in the first and second circuit branches;

biasing a first mirror transistor to have a different gate-to-source voltage than the current control transistor, the first mirror transistor having a gate connected to the gate of the current control transistor to produce a first mirror current; and biasing a reference transistor and a second mirror transistor to have different gate-to-source voltages from one another, the reference transistor and second mirror transistor having gates connected to one another, the reference transistor having a source-drain path connected to receive the first mirror current, and the second mirror transistor having a source-drain path connected to the common node.

10. The method of claim 9, wherein the step of biasing the first mirror transistor comprises:

conducting the first current through a resistor connected between the source of the current control transistor and a power supply voltage;

wherein the source of the first mirror transistor is connected to the power supply voltage.

11. The method of claim 9, wherein the step of biasing the reference transistor and the second mirror transistor comprises:

conducting the first mirror current through a resistor connected between the source of the reference transistor and a ground voltage;

wherein the source of the second mirror transistor is connected to the ground voltage.

12. The method of claim 9, further comprising:

obtaining a bandgap reference voltage at a drain node of the current control transistor.

13. The method of claim 9, wherein the current control transistor and the first mirror transistor are each p-channel metal-oxide-semiconductor transistors;

and wherein the reference transistor and the second mirror transistor are each n-channel metal-oxide-semiconductor transistors.

* * * * *